US009139318B2

(12) United States Patent
Lee

(10) Patent No.: US 9,139,318 B2
(45) Date of Patent: Sep. 22, 2015

(54) PACKING INSTRUMENT FOR A BOOKBINDING SPRING

(75) Inventor: Ki Jong Lee, Yongin-si (KR)

(73) Assignee: Spiral Binding Company, Inc., Totowa, NJ (US)

( * ) Notice: Subject to any disclaimer, the term of this patent is extended or adjusted under 35 U.S.C. 154(b) by 1122 days.

(21) Appl. No.: 13/059,981

(22) PCT Filed: Sep. 2, 2008

(86) PCT No.: PCT/KR2008/005155

§ 371 (c)(1),
(2), (4) Date: Feb. 20, 2011

(87) PCT Pub. No.: WO2009/154328

PCT Pub. Date: Dec. 23, 2009

(65) Prior Publication Data

US 2011/0239589 A1 Oct. 6, 2011

(30) Foreign Application Priority Data

Jun. 16, 2008 (KR) ..... 10-2008-0056347

(51) Int. Cl.

*B65B 11/08* (2006.01)
*B65B 51/16* (2006.01)
*B65B 5/04* (2006.01)
(Continued)

(52) U.S. Cl.

CPC . *B65B 51/16* (2013.01); *B65B 5/04* (2013.01); *B65B 9/067* (2013.01); *B65H 54/76* (2013.01); *B42B 5/10* (2013.01); *B65B 2220/08* (2013.01); *B65H 2701/391* (2013.01); *B65H 2701/3916* (2013.01); *B65H 2801/48* (2013.01)

(58) Field of Classification Search

CPC ..... B65B 5/04; B65B 9/06; B65B 9/067; B65B 11/02; B65B 11/08
USPC ..... 53/114, 203, 450, 550, 563, 574, 575
See application file for complete search history.

(56) References Cited

U.S. PATENT DOCUMENTS 2,114,008 A * 4/1938 Wunderlich ..... 100/87
2,430,098 A * 11/1947 Binch ..... 53/114
(Continued)

FOREIGN PATENT DOCUMENTS

JP 10-155598 6/1998

OTHER PUBLICATIONS

International Search Report for PCT/KR2008/005155 Mailed on Apr. 7, 2009.

*Primary Examiner* — Gloria R Weeks
(74) *Attorney, Agent, or Firm* — Gloria Tsui-Yip, Esq.; Wendi O. Uzar, Esq.

(57) ABSTRACT

The packing device having a supply frame on which a spring is provided. A cover member supply part, which is formed of a supply roll on which a cover member having a certain width, is wound and rotates, and a direction change roll for allowing a cover member to be supplied on an upper side of the spring, with the spring being placed on an upper side of the supply frame. A forming guide is provided and one end is extended at a tapered angle in a conical shape, while surrounding an upper surface of the cover member, as being closer to an end of the supply frame, and the other end surrounds the spring excluding the portion in which both sides of the cover member are overlapped. A pair of pressing rollers is provided for pressing and bonding the cover members and one driving roller for transferring the packed spring.

2 Claims, 4 Drawing Sheets

(51) Int. Cl.

| | |
|---|---|
| ***B65H 54/76*** | (2006.01) |
| ***B65B 9/067*** | (2012.01) |
| *B42B 5/10* | (2006.01) |

(56) References Cited

U.S. PATENT DOCUMENTS

| | | | | | |
|---|---|---|---|---|---|
| 2,737,000 | A | * | 3/1956 | McCargar | 53/511 |
| 3,059,387 | A | * | 10/1962 | Fasanella | 53/418 |
| 3,173,188 | A | * | 3/1965 | Wexler | 53/399 |
| 3,415,171 | A | * | 12/1968 | Wilson | 493/302 |
| 3,668,816 | A | * | 6/1972 | Thompson | 53/418 |
| 3,827,210 | A | * | 8/1974 | Smalley et al. | 53/434 |
| 3,939,622 | A | * | 2/1976 | Murphy et al. | 53/432 |
| 4,043,098 | A | * | 8/1977 | Putnam et al. | 53/551 |
| 4,328,655 | A | * | 5/1982 | Spencer et al. | 53/439 |
| 4,363,819 | A | * | 12/1982 | Steffen | 426/132 |
| 4,439,977 | A | * | 4/1984 | Stumpf | 53/428 |
| 4,479,283 | A | * | 10/1984 | Hollingsworth | 452/22 |
| 4,514,965 | A | * | 5/1985 | Adachi et al. | 53/553 |
| 4,854,023 | A | * | 8/1989 | Stumpf | 29/91 |
| 4,907,393 | A | * | 3/1990 | Omori et al. | 53/410 |
| 4,909,018 | A | * | 3/1990 | Yamamoto | 53/450 |
| 4,947,605 | A | * | 8/1990 | Ramsey | 53/442 |
| 4,950,345 | A | * | 8/1990 | Kreager et al. | 156/203 |
| 4,958,477 | A | * | 9/1990 | Winkler | 53/138.3 |
| 4,986,518 | A | * | 1/1991 | Stumpf | 267/91 |
| 5,113,635 | A | * | 5/1992 | Takai et al. | 53/52 |
| 5,126,004 | A | * | 6/1992 | Suenens et al. | 156/556 |
| 5,177,935 | A | * | 1/1993 | Jones et al. | 53/433 |
| 5,226,269 | A | * | 7/1993 | Stoltenberg | 53/436 |
| 5,438,718 | A | * | 8/1995 | Kelly et al. | 5/720 |
| 5,524,420 | A | * | 6/1996 | Ikuta | 53/450 |
| 5,548,946 | A | * | 8/1996 | Holub | 53/550 |
| 5,553,443 | A | * | 9/1996 | St. Clair et al. | 53/440 |
| 5,564,261 | A | * | 10/1996 | Kiner | 53/439 |
| 5,566,526 | A | * | 10/1996 | Suga | 53/75 |
| 5,572,853 | A | | 11/1996 | St. Clair et al. | |
| 5,613,287 | A | * | 3/1997 | St. Clair | 29/91.1 |
| 5,799,467 | A | * | 9/1998 | Nankervis et al. | 53/450 |
| 6,021,627 | A | * | 2/2000 | Mossbeck et al. | 53/438 |
| 6,101,697 | A | * | 8/2000 | Stumpf et al. | 29/91 |
| 6,122,898 | A | * | 9/2000 | De Kort | 53/450 |
| 6,260,331 | B1 | * | 7/2001 | Stumpf | 53/436 |
| 6,263,643 | B1 | * | 7/2001 | Kovacs et al. | 53/459 |
| 6,428,457 | B1 | * | 8/2002 | Fukuda et al. | 493/302 |
| 6,467,239 | B2 | * | 10/2002 | Mossbeck et al. | 53/430 |
| 6,499,275 | B1 | | 12/2002 | Graf et al. | |
| 6,662,527 | B1 | * | 12/2003 | Suga | 53/374.6 |
| 6,684,608 | B2 | * | 2/2004 | Gibbons | 53/436 |
| 7,003,929 | B2 | * | 2/2006 | Laplace | 53/451 |
| 7,582,006 | B2 | * | 9/2009 | Bolzacchini | 452/32 |
| 8,286,549 | B2 | * | 10/2012 | Auf Der Heide et al. | 99/450.7 |
| 2002/0026770 | A1 | * | 3/2002 | Gibbons | 53/114 |
| 2004/0206051 | A1 | * | 10/2004 | Gecic et al. | 53/430 |
| 2011/0099947 | A1 | * | 5/2011 | Vadlja et al. | 53/428 |

* cited by examiner

PACKING INSTRUMENT FOR A BOOKBINDING SPRING

RELATED APPLICATIONS

This application is a 371 application of International Application No. PCT/KR2008/005155, filed Sep. 2, 2008, which in turn claims priority from Korean Patent Application No. 10-2008-0056347, filed Jun. 16, 2008, each of which is incorporated herein by reference in its entirety.

TECNHICAL FIELD

The present invention relates to a packing device for a bookbinding device, and in particular to a packing device for a bookbinding spring in which an outer surrounding side of a bookbinding spring is packed as actually looking like it surrounds the same in series and is directly accommodated into a box or a pocket for thereby simplifying a packing work while reducing any inconveniences which might occur due to a recovery of bobbins.

BACKGROUND ART

What looks like a spring or the like as being generally formed in a cylindrical shape in series is called a bookbinding spring.

There are various kinds of bookbinding springs in the industry, which are classified depending on their sale type.

Since a book publication company does not directly produce any bookbinding springs, a bookbinding spring should be purchased from a bookbinding spring manufacturer. In case that a bookbinding spring is consumed in a bulk package, it is sold in a state that a bookbinding spring is wound on a huge bobbin or the something like a reel. The bookbinding spring might be cut and sold in a customized shape depending on a standard paper size for example A4 or A5 in a narrow or standardized place.

FIG. 4 is a schematic view illustrating a conventional packing device for a bookbinding spring, and FIG. 5 is a side view illustrating a conventional packing device for a bookbinding spring. An interference prevention sheet 71 is supplied from a roll 72, on which an interference prevention sheet is originally wound, from a lower side of a packing device, and a reel shaped bobbin 7 is wound by means of a guide frame 73 from an upper side of the device, with a spring 1 supplied in series from a spring producing device being mounted on the guide frame.

The above bookbinding springs 1 are overlapped in the gaps formed between the neighboring springs, so there are a lot of problems in the actual use of the same. In particular, more problems occur in the course of binding work.

In order to overcome the above problems, an interference prevention sheet 71 is wound on the bobbin 7 while surrounding at least three sides.

However, the above packing method has a lot of problems lying in a recovery cost caused as a huge size bobbin 7 is used and recovered for a reuse and an inefficient transportation caused due to a bulky volume of the bobbin 7.

In addition, in the conventional art, it takes a lot of time to rewind on another bobbin after a packing work on one bobbin is finished. The amount of springs to be wound on one bobbin is very limited due to a relatively huge bobbin.

DISCLOSURE OF INVENTION

Technical Problem

Accordingly, it is an object of the present invention to provide a packing device for a bookbinding spring which overcomes the problems encountered in the conventional art.

It is another object of the present invention to provide a packing device for a bookbinding spring which makes it possible to easily pack a bookbinding spring without using a bobbin.

It is further another object of the present invention to provide a packing device for a bookbinding spring which makes it possible to pack more bookbinding springs based on the same time and volume as compared to a conventional packing device.

Technical Solution

To achieve the above objects, in a packing device of a bookbinding spring in which a spring used for binding books is produced in series and packs the same by a certain amount for sale, there is a packing device of a bookbinding spring which comprises a supply frame on which a spring supplied in series from a spring producing device is provided and supplied in series as well; a cover member supply part which is formed of a supply roll on which a cover member having a certain with and made of a synthetic resin material is wound and rotates, and a direction change roll for allowing a cover member supplied from the supply roll to be supplied on an upper side of the spring, with the spring being placed on an upper side of the supply frame and being supplied; a forming guide of which one end is extended at a tapered angle in a conical shape, while surrounding an upper surface of the cover member, as being closer to an end of the supply frame, and the other end surrounds the spring excluding the portion in which both sides of the cover member are overlapped in the lower side of the same; a pair of pressing rollers for pressing and bonding the portions in which both sides of the cover member are overlapped by means of the forming guide; and at least one driving roller for transferring the spring packed by means of the bonding part with the helps of the pressing roller.

The forming guide is formed in a shape that a plate sheet is rolled in a conical shape, with a lower side of the forming guide being equipped with a bent part of which both rolled ends are vertically and downwardly bent at a certain interval.

Advantageous Effects

In the present invention, since the present invention can decrease the cost needed for recovering the bobbins since the bobbins are not used in the present invention.

In addition, the work time, which might be delayed due to a process for winding on the bobbins, can be significantly decreased.

The springs and each having a certain length that a customer needs can be selectively packed, with the spring being supplied in the packed and accommodated states.

BRIEF DESCRIPTION OF DRAWINGS

The present invention will become better understood with reference to the accompanying drawings which are given only by way of illustration and thus are not limitative of the present invention, wherein.

DESCRIPTION OF REFERENCE NUMBERS

Figure 1:
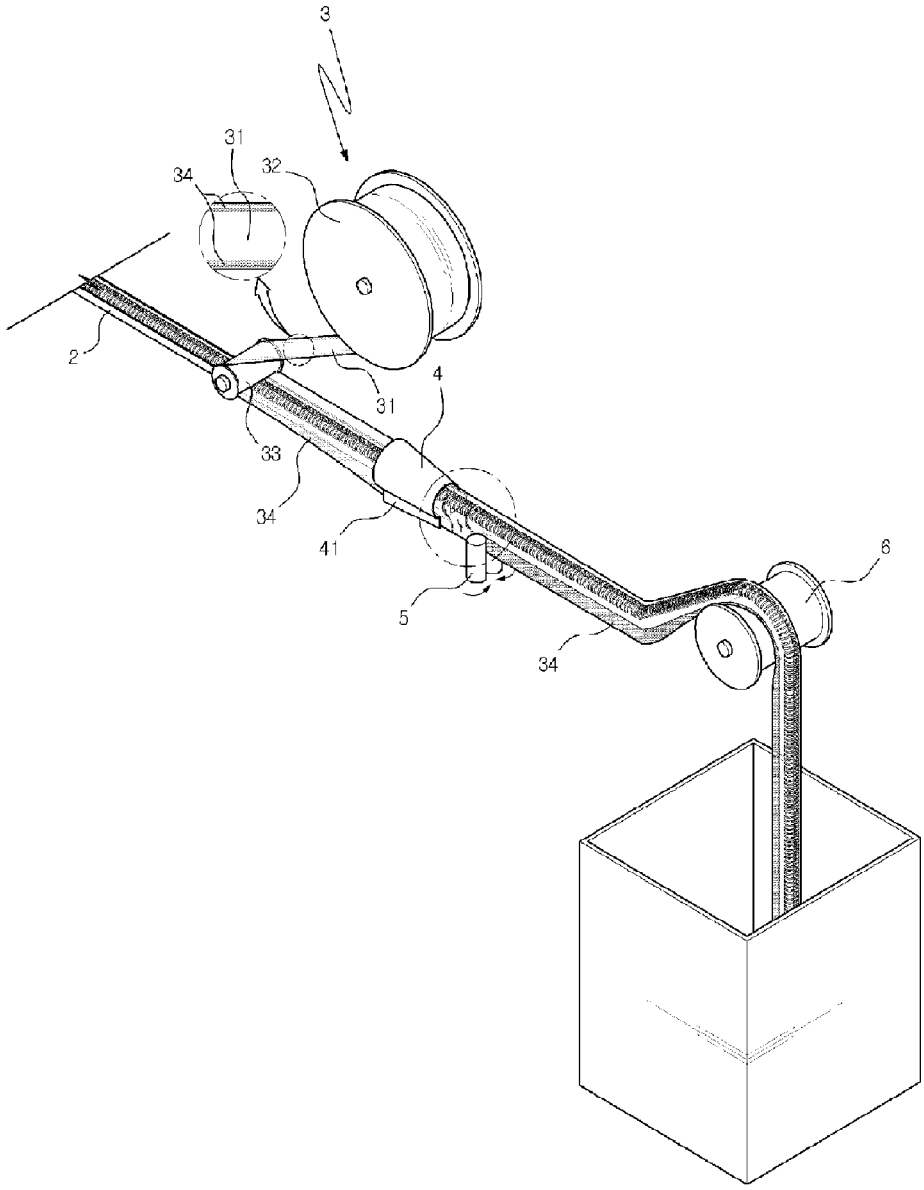
FIG. 1 is a schematic view illustrating a packing device for a bookbinding spring according to the present invention.

1: spring 2: spring which comprises a supply frame
3: cover member supply part 31: cover member
32: supply roll 33: direction change roll
34: the bonding part 4: forming guide
41: bent part 5: pressing roller
6: driving roller 7: bobbin
71: interference prevention sheet 72: roll
73: guide frame

BEST MODE FOR CARRYING OUT THE INVENTION

In a packing device of a bookbinding spring in which a spring 1 used for binding books is produced in series and packs the same by a certain amount for sale, there is provided a packing device of a bookbinding spring which comprises a supply frame 2 on which a spring 1 supplied in series from a spring producing device is provided and supplied in series as well; a cover member supply part 3 which is formed of a supply roll 32 on which a cover member 31 having a certain with and made of a synthetic resin material is wound and rotates, and a direction change roll 33 for allowing a cover member 31 supplied from the supply roll 32 to be supplied on an upper side of the spring 1, with the spring 1 being placed on an upper side of the supply frame 2 and being supplied; a forming guide 4 of which one end is extended at a tapered angle in a conical shape, while surrounding an upper surface of the cover member, as being closer to an end of the supply frame, and the other end surrounds the spring 1 excluding the portion in which both sides of the cover member 31 are overlapped in the lower side of the same; a pair of pressing rollers 5 for pressing and bonding the portions in which both sides of the cover member 31 are overlapped by means of the forming guide 4; and at least one driving roller 6 for transferring the spring 1 packed by means of the bonding part 34 with the helps of the pressing roller 5.

MODE FOR THE INVENTION

The preferred embodiments of the present invention will be described with reference to the accompanying drawings.

Figure 2:
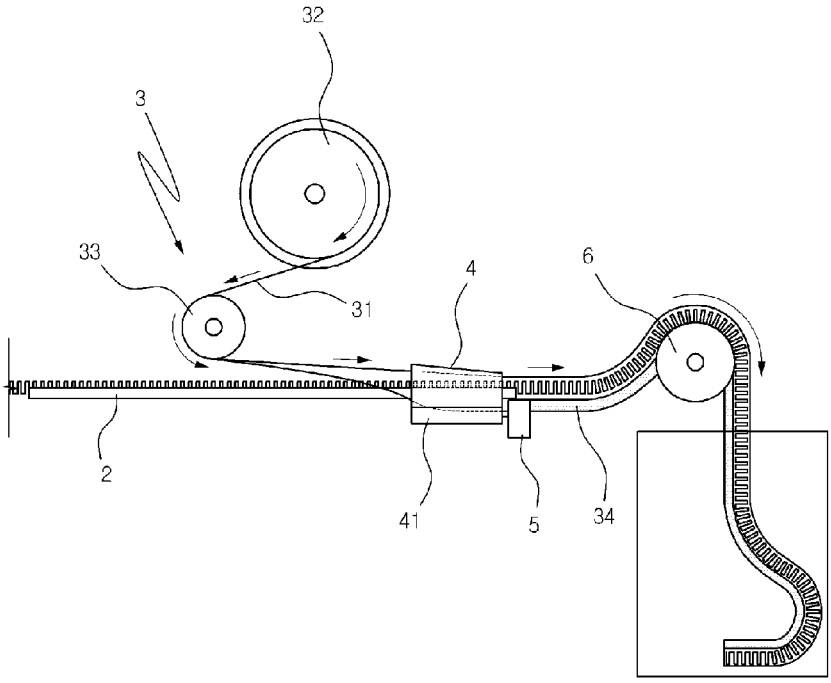
FIG. 2 is a side view illustrating a packing device for a bookbinding spring according to the present invention.
Figure 3:
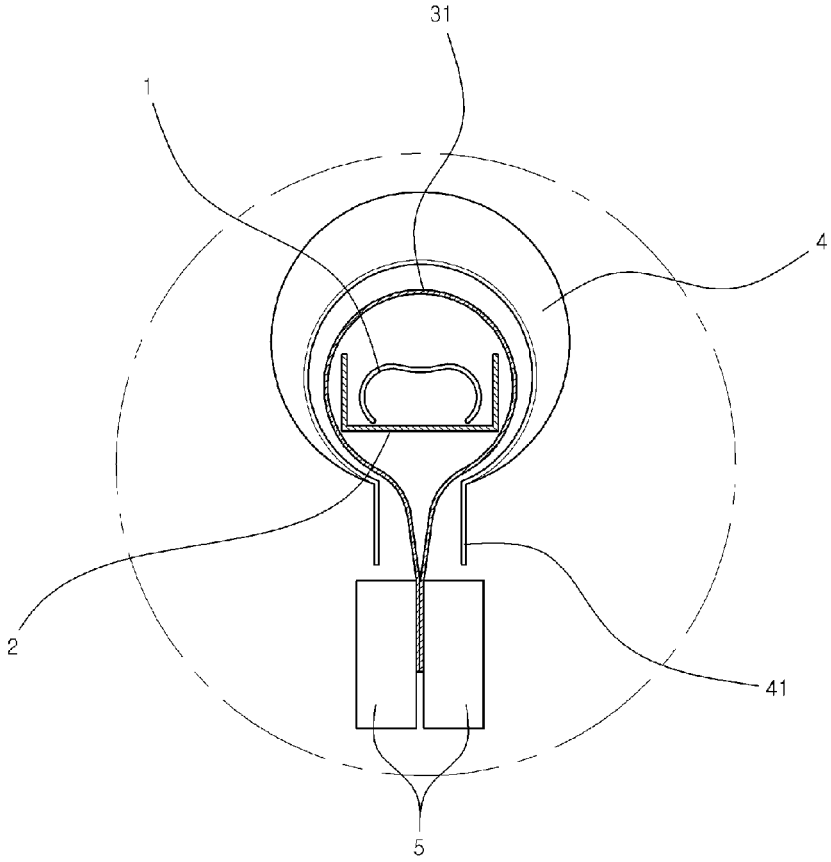
FIG. 3 is a partial cross sectional view illustrating a packing device for a bookbinding spring according to the present invention.
Figure 4:
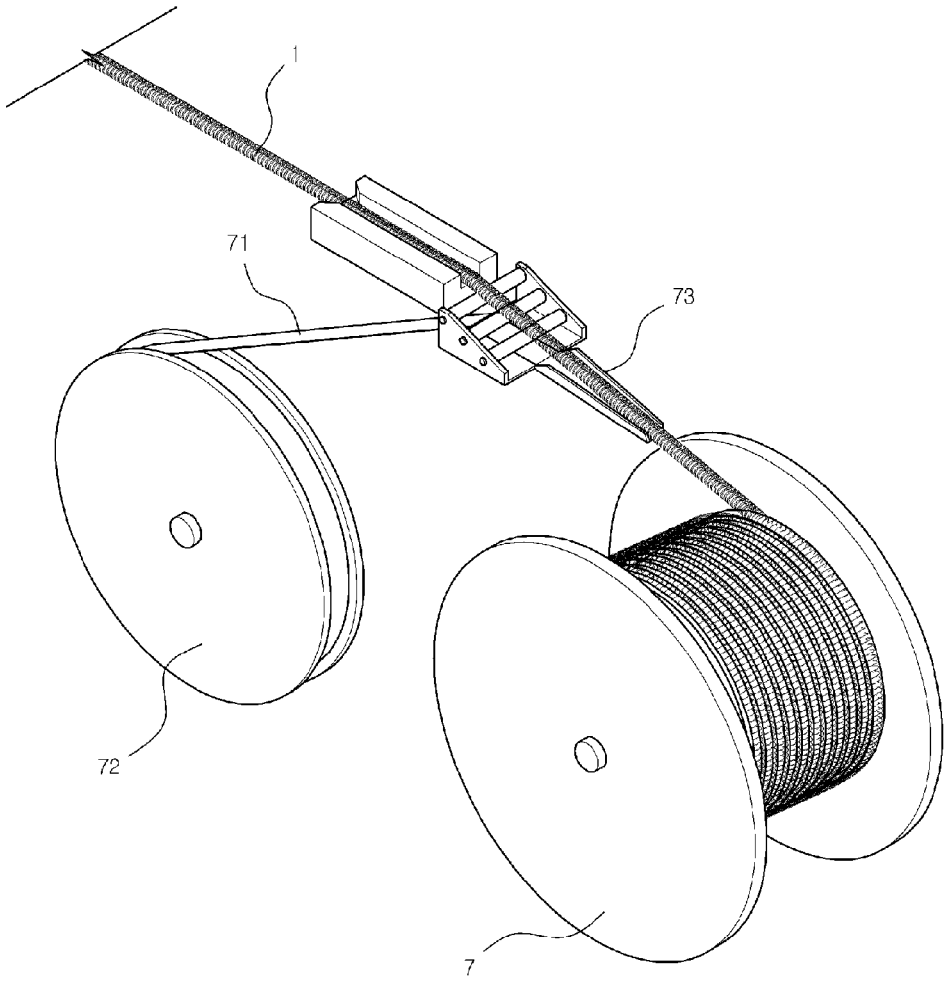
FIG. 4 is a schematic view illustrating a conventional packing device for a bookbinding spring.
Figure 5:
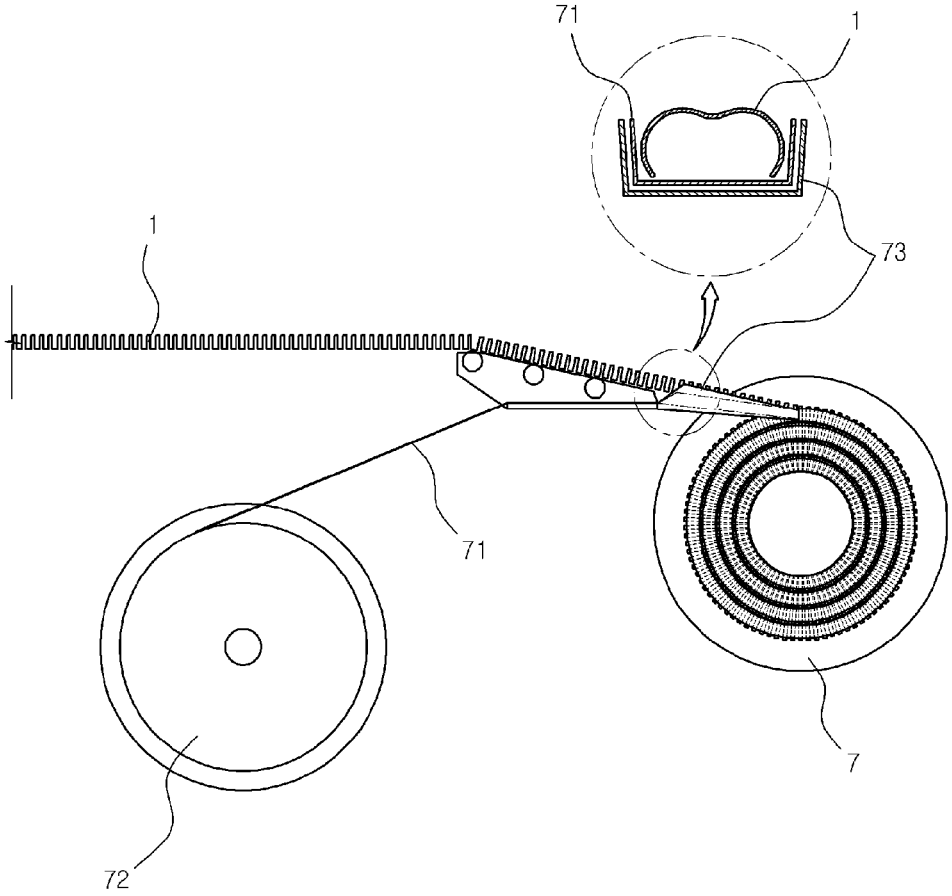
FIG. 5 is a side view illustrating a conventional packing device for a bookbinding spring.

FIG. 1 is a schematic view illustrating a packing device for a bookbinding spring according to the present invention. FIG. 2 is a side view illustrating a packing device for a bookbinding spring according to the present invention. FIG. 3 is a partial cross sectional view illustrating a packing device for a bookbinding spring according to the present invention.

In a packing device of a bookbinding spring in which a spring 1 used for binding books is produced in series and packs the same by a certain amount for sale, there is provided a packing device of a bookbinding spring which comprises a supply frame 2 on which a spring 1 supplied in series from a spring producing device is provided and supplied in series as well.

It is preferred that the supply frame 2 is configured to have its both sides protruded or bent for a safe supply of the spring 1, so that it can be reliably transferred without dropping down.

There are further provided a cover member supply part 3 which is formed of a supply roll 32 on which a cover member 31 having a certain with and made of a synthetic resin material is wound and rotates, and a direction change roll 33 for allowing a cover member 31 supplied from the supply roll 32 to be supplied on an upper side of the spring 1, with the spring 1 being placed on an upper side of the supply frame 2 and being supplied; a forming guide 4 of which one end is extended at a tapered angle in a conical shape, while surrounding an upper surface of the cover member, as being closer to an end of the supply frame, and the other end surrounds the spring 1 excluding the portion in which both sides of the cover member 31 are overlapped in the lower side of the same; and a pair of pressing rollers 5 for pressing and bonding the portions in which both sides of the cover member 31 are overlapped by means of the forming guide 4.

Namely, a cover member 31 made of a polyethylene(PE) material which is generally used for a packing material in a form of a synthetic resin is supplied like surrounding from an upper side of the spring 1, so overlapped ends are bonded by means of a pressing roller 5.

Here, it is obvious to those who skilled in the art that the material of the cover member 31 is not limited to a synthetic resin material, but it might be made of cloth or paper sheet.

The bookbinding spring 1, which is supplied in series, is supplied in series as well in a packet state by means of the cover member 31. The transportation of the packed spring is finally transferred by means of at least one driving roller 6 which is configured to transfer the spring 1 to be packed with a bonded part 34 by means of the pressing roller 5.

In the above embodiment of the present invention, the spring might be sold as being wound on the bobbin like in the conventional art, but the bookbinding spring 1 packed according to the present invention can be sold as being stored in a box or a pocket as compared to a conventional interference prevention sheet.

The size of the box or the pocket might be determined depending on the sale units, so it is possible to pack and ship the bookbinding springs in various size units.

In case of the springs wound by means of the conventional bobbin, it is possible to wind more springs as compared to the windings of the present invention, but the winding amount of the present invention is more than that of the conventional art in their unit winding volumes because the conventional bobbin is so huge.

The binding part 34 might be formed by coating a bonding substance on the cover member 31, which is initially supplied, and the bonding process is performed by means of a pressing work of the pressing roller 5. The binding part 34 might be bonded by means of a thermal melting method as heat is applied to the pressing roller 5 depending on its given work situation.

The pressing roller 5 is configured to closely contact the cover member 31 with the helps of its material, and a high frequency melting and boding might be performed along with the pressing roller in another embodiment of the same.

The pressing roller 5 is basically configured to form the bonding part 34, but since it is not needed to fully seal the inner and outer sides of the same the bonding part 34 might be straight bonded in at least two parallel lines or might be spot-bonded at regular intervals.

In case of the spot bonding, it is possible to easily remove the cover member 31 to be packed in the following process.

In the present invention, a forming guide 4 is formed in such a manner that a sheet material is rolled in a conical shape with its lower side being equipped with a bent part 41 of which two ends are bent vertically and downwardly at certain intervals.

The forming guide 4 is named as it is capable of forming something in a certain shape. It is configured to be a little different as compared to a forming device which is conventionally used in the industry.

Namely, the forming guide 4 according to the present invention does not need a high precision in its work. It just needs a small margin enough to form the bonding part 34 in a downward direction while surrounding the spring 1. It is possible to achieve the same purpose as the present invention unless a tapered portion is formed.

In the embodiment of the present invention, the forming guide 4 is limited to the tapered shape so that those who skilled in the art can easily modify because its construction and method are simply.

INDUSTRIAL APPLICABILITY

As described above, since the present invention can decrease the cost needed for recovering the bobbins since the bobbins are not used in the present invention.

In addition, the work time, which might be delayed due to a process for winding on the bobbins, can be significantly decreased.

The springs and each having a certain length that a customer needs can be selectively packed, with the spring being supplied in the packed and accommodated states.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

SEQUENCE LISTING bookbinding, spring, packing, bobbin

The invention claimed is:

1. A combination of a spring for binding books and a device for packing said spring into a box for shipping, said device having an input end and an output end, the combination comprising:

a. a continuous, uncompressed, spirally-wound spring 1 having a cross-sectional circumference, a first end and a second end and an upper side and a lower side when positioned in a generally horizontal position;

b. one fixedly positioned driving roller at the output end that continuously drives said spring from said input end through said output end in a generally horizontal position;

c. a fixed supply frame 2 at the input end on which said lower side of said spring 1 rests directly on and said spring is moved relative to said fixed supply frame 2 from said input end through said output end by said driving roller;

d. a cover member supply part 3 comprises:

i. a supply roll 32;

ii. a cover member 31 having a certain width wider than said circumference of said spring and made of a synthetic resin material is wound on said supply roll; and iii. a direction change roll 33 for allowing said cover member 31 supplied from said supply roll 32 to be supplied on said upper side of said spring 1, when said lower side of said spring is resting directly on said fixed supply frame 2;

e. a forming guide 4 fixedly positioned relative to said fixed supply frame and surrounds said fixed supply frame and said spring 1 thereon having a tapered angle conical shape with opposite ends, said end facing the input end receives said spring with said cover member on the upper side of said spring 1, said opposite end facing the output end causes said cover member 31 to overlap itself on said lower side of said spring; and f. a pair of pressing rollers 5 adjacent the opposite end of said forming guide for pressing and bonding the overlapped portion of said cover member 31 at said lower side of said spring 1.

2. The device of claim 1, wherein said forming guide 4 is formed from a plate sheet rolled into the tapered angle conical shape, said forming guide 4 having a lower side with a bent part 41 for receiving said overlapped portion of the cover member thereon.

* * * * *